US011110032B2

(12) United States Patent
Bazin

(10) Patent No.: US 11,110,032 B2
(45) Date of Patent: Sep. 7, 2021

(54) FILLABLE 3D FLEXIBLE POUCH FOR BIOPHARMACEUTICAL FLUIDS, AND METHOD FOR PRODUCING SUCH A POUCH

(71) Applicant: SARTORIUS STEDIM FMT SAS, Aubagne (FR)

(72) Inventor: Frédéric Bazin, Cassis (FR)

(73) Assignee: SARTORIUS STEDIM FMT SAS, Aubagne (FR)

( * ) Notice: Subject to any disclaimer, the term of this patent is extended or adjusted under 35 U.S.C. 154(b) by 59 days.

(21) Appl. No.: 16/344,910

(22) PCT Filed: Nov. 22, 2017

(86) PCT No.: PCT/FR2017/000216
§ 371 (c)(1),
(2) Date: Apr. 25, 2019

(87) PCT Pub. No.: WO2018/096226
PCT Pub. Date: May 31, 2018

(65) Prior Publication Data

US 2019/0274923 A1 Sep. 12, 2019

(30) Foreign Application Priority Data

Nov. 25, 2016 (FR) ..... 1670709

(51) Int. Cl.
*A61J 1/10* (2006.01)
*B65B 3/04* (2006.01)
*B65D 77/06* (2006.01)

(52) U.S. Cl.
CPC ..... *A61J 1/10* (2013.01); *B65B 3/045* (2013.01); *B65D 77/06* (2013.01)

(58) Field of Classification Search
CPC ..... B65B 3/045; B65D 77/06; B65D 77/065; B65D 31/10; B31B 2155/001;
(Continued)

(56) References Cited

U.S. PATENT DOCUMENTS 5,547,284 A * 8/1996 Imer ..... B65D 75/5866 383/104
5,788,121 A * 8/1998 Sasaki ..... B65D 77/065 222/105

(Continued)

FOREIGN PATENT DOCUMENTS

EP 0326730 A 8/1988
FR 2781202 A1 1/2000

(Continued)

OTHER PUBLICATIONS

Search Report for French Patent Application No. 1670709 dated Jul. 20, 2017.

(Continued)

*Primary Examiner* — Thomas M Wittenschlaeger
(74) *Attorney, Agent, or Firm* — Heslin Rothenberg Farley & Mesiti P.C.

(57) ABSTRACT

The invention relates to a 3D flexible pouch to be filled with a biopharmaceutical product, produced by assembling two wall elements and two gussets. At least one connection port can be provided for filling and/or emptying. A substantially parallelepipedic configuration is obtained in a filled state by unfolding the gussets and folding the flaps of the two wall elements. A welded seam is produced in a join portion formed at one end and cut out in a V shape, so as to directly connect the two wall elements. In a substantially flat configuration of the empty flexible pouch, the join portion projects axially outwards in relation to the gussets and is (Continued)

defined by two edges which are oblique in relation to a longitudinal axis of said pouch.

22 Claims, 5 Drawing Sheets

(58) Field of Classification Search
CPC .... B31B 2155/0012; B31B 2155/0014; B31B 2155/002; B31B 2155/003; A61J 1/10
See application file for complete search history.

(56) References Cited

U.S. PATENT DOCUMENTS 5,988,422 A * 11/1999 Vallot ..... A61J 1/05 220/62.22
6,332,711 B1 * 12/2001 Inuzuka ..... B65D 31/02 383/104
6,371,646 B1 * 4/2002 LaFleur ..... B29C 66/004 383/109
6,527,445 B2 * 3/2003 LaFleur ..... B65D 88/1618 383/120
6,659,132 B2 * 12/2003 Smith ..... B65D 90/046 138/89
7,244,064 B2 * 7/2007 Sullivan, Jr. ..... B65D 75/563 383/111
7,798,711 B2 * 9/2010 Plunkett ..... B65D 88/1668 383/22
7,980,410 B2 * 7/2011 De Muinck ..... B65D 77/065 220/495.06
8,075,188 B2 * 12/2011 Plunkett ..... B65D 33/02 383/119
8,182,152 B2 * 5/2012 Plunkett ..... B65D 88/1656 383/105
8,806,843 B2 * 8/2014 Chang ..... B65D 75/008 53/467
9,346,612 B2 * 5/2016 Plunkett ..... B65D 88/1618
10,046,870 B2 * 8/2018 Ouellette ..... B65D 33/007
10,532,837 B2 * 1/2020 Baud ..... B65B 67/1233
2003/0024950 A1 * 2/2003 Yoneyama ..... B65D 33/06 222/105
2005/0220369 A1 * 10/2005 Sullivan, Jr. ..... B65D 75/563 383/22
2008/0310766 A1 * 12/2008 Plunkett ..... B65D 77/06 383/22
2012/0028039 A1 2/2012 Klenke
2019/0256270 A1 * 8/2019 Bazin ..... B65D 31/10

FOREIGN PATENT DOCUMENTS

WO 0001431 A1 1/2000
WO 0004131 A1 1/2000
WO 2015118269 A1 8/2015

OTHER PUBLICATIONS

International Search Report (and English translation) and Written Opinion of the International Searching Authority for International Patent Application No. PCT/FR2017/000216 dated Feb. 19, 2018. English Translation of the Written Opinion of the International Searching Authority for PCT/FR2017/000216 dated Feb. 19, 2018.

* cited by examiner

FILLABLE 3D FLEXIBLE POUCH FOR BIOPHARMACEUTICAL FLUIDS, AND METHOD FOR PRODUCING SUCH A POUCH

CROSS REFERENCE TO RELATED APPLICATIONS

This application is a national stage filing under section 371 of International Application No. PCT/FR2017/000216, filed on Nov. 22, 2017, published on May 31, 2018 as WO 2018/096226 A1 which claims priority to French Patent Application No. 1670709, filed on Nov. 25, 2016. The entire disclosure of each application is hereby incorporated herein by reference.

The invention relates to the field of packaging biopharmaceutical fluids and relates, more particularly, to a fillable flexible reservoir, in the form of a 3D (three-dimensional) flexible pouch, which must generally be placed in a rigid container. The invention also relates to an equipment and a method for producing such a 3D flexible pouch.

BACKGROUND

By "biopharmaceutical product", this means a product coming from biotechnology, culture environments, cell cultures, buffer solutions, artificial nutrition liquids, blood products and derivatives of blood products, or a pharmaceutical product, or more generally, a product intended to be used in the medical field. Such a product is in liquid, paste, or possible powder form. The invention also applies to the filling of flexible pouches with other products but subjected to similar requirements concerning the packaging thereof.

In 3D pouches of this type, single-use and intended to receive a biopharmaceutical product (of international class A61J 1/05 according to the international or cooperative classification), the volume is typically defined by a lower end wall, an upper end wall and a flexible side wall, which could be found in two extreme states—folded flat and unfolded deployed. The 3D pouch can be deformed to pass from one to the other of these states or be in any intermediate state. The walls of the pouch, composed of a single-layer or multilayer film, made of plastic material such as polyethylene or a complex comprising polyethylene, define an inner space which, in the folded state, is of minimal volume and, in unfolded and deployed state, is maximal. This space is intended to receive the biopharmaceutical product for the storage, the treatment, the transportation. Such a flexible, biocompatible, single-use pouch can define a significant volume of 2 or 5 liters at least, up to 3000 liters, even more, which justifies it being qualified as 3D. Such a pouch thus offers a significant capacity while being able to be easily stored. An example of such a pouch is described in international application WO00/04131 or in document FR 2781202. Contrary to the pouches, of which only the bottom has a gusset (with an increased risk of ruptures), it is preferable to create two opposite gussets, illustrated in FIGS. 3 to 5 of document WO00/04131. The welded seams of the top and bottom of the pouch are made in a K shape, before proceeding with cutting angle portions (cut to remove the outer parts of the films beyond the welding zones).

Sometimes, the products contained in this type of pouch are used at thousands of kilometers away from the place where the pouch has been filled. These products often have a high financial value, even often a high value for the health of individuals, since they can be used, for example, for the production of medicaments intended for human health. It is therefore essential that these pouches safely reach the destination thereof, full of liquid with which they have been filled at the start, and uncontaminated.

In certain options, the pouch can also comprise sensors (temperature, pH, physico-chemical characterization of the biomass) and/or a treatment member, for example in the form of a mixed which can be actuated by mechanical or mobile coupling by magnetic driving.

Regarding numerous stresses to which these pouches are subjected, in particular during the transportation thereof of during certain treatments of the biopharmaceutical product: accelerations, braking, tossing, shocks, vibrations, etc. (i.e. numerous forces, of which shearing forces, which tend to alter the film which constitutes them, in particular in sensitive places like the folds), it is essential to form the connection port(s), being used in particular for the filling or the emptying, in a portion of the pouch which is separate from the welding zones. Furthermore, these connection ports are the only ones with access to the inner space, the pouches having no hinged or removable cover, opening/closing flap, peelable or tearable portion, and having no fragile zones. The pouches have no weak zones in the welding zones.

It can be provided that the pouch is provided with a port for entering or introducing a biopharmaceutical product and a gas supply port, for example on the side of an upper end wall. Corresponding supply ducts, each connected to a supply source (which is generally outside of the rigid container being used to transport and store the 3D pouch in the filled state), are connected to these respective ports. Alternatively, the filling can be done by using a lower supply line. Document EP-B1-0326730 describes a filling of this type, with the disadvantage that the flexible pouch is more complex, this being equipped with side components, which limits the interest in this type of option. It is generally desirable to limit the complexity and the cost of the 3D flexible pouch which is a single-use consumable (here, this is the flexible pouch without any possible accessories).

The K-shaped welded seam is also applied for pouches for medical or medicinal use (also single-use) which have a wide upper opening in a deployed, parallelepiped configuration, as described in particular in U.S. Pat. No. 6,332,711 B1. In this case, it is preferable to provide a lower connection port for the emptying.

In practice, the production of a K-shaped welded seam has proven to be difficult and involves numerous welded seam and cutting operations. The production cost is thus particularly difficult to lower. Furthermore, the seams between three welded strips represent relatively fragile zones, which can be subjected to significant torsion stresses during the filling process and/or during transportation operations.

There is therefore a need for a robust 3D pouch, suitable for the conservation, the treatment, and/or the transportation of biopharmaceutical fluid (of volume of 50 liters or more), which is simple to product and robust, by limiting the risk of degradation in the most fragile zones.

SUMMARY OF THE INVENTION

According to a first aspect, the invention aims for a 3D flexible pouch (with gussets) for a biopharmaceutical product, designed to be deployed from a flat, empty configuration to a substantially parallelepiped configuration in a filled state.

The 3D flexible pouch has:

- a first wall element consisting of a film and making it possible to define a front face, the first wall element having two side edges distributed on either side of a longitudinal axis of the pouch in the flat configuration, a second wall element consisting of a film and making it possible to define a rear face, the second wall element having two side edges distributed on either side of said longitudinal axis of the pouch in the flat configuration, a first gusset and a second gusset, each connected to two side edges on either side of the first and second wall elements, the first gusset and the second gusset being constituted by respective films, cut from one piece and each likely to be folded, typically in two, along a folding line towards the inside which extends between two opposite ends of the flexible pouch, the longitudinal axis of the flexible pouch extending between the folding line of the first gusset and the folding line of the two gusset in the flat configuration, with the particularity that, at one of the two opposite ends, the films respectively constituting the first wall element and the second wall element are welded directly to one another to define a join portion common to the side edges which, in the flat configuration, projects axially towards the outside with respect to the first and second gussets and is defined by two edges which are oblique with respect to the longitudinal axis.

By these provisions, the flexible pouch has a join portion which extends axially beyond a zone for folding in two the gussets and constitutes a reinforcement element which reduces the torsion stresses exerted in the direct welding zone between the first wall element and the second wall element. Thus, the fragilities at the transition joins between four layers is reduced (on the side of either of the gussets, folded in two) and two layers (intermediate direct adhesion zone between the first wall element and the second wall element).

Preferably, the two oblique edges join together at a free end of the join portion and, in the flat configuration, these two oblique edges are spread apart from one another by moving away from the free end and are each extended, opposite the free end, rectilinearly, at least by one section of the side edges which is welded to a longitudinal edge section of one from among the first gusset and the second gusset. The two oblique edges are typically straight.

This arrangement at one of the ends of the pouch makes it possible to define the first wall element and/or the second wall only, by only two sides which join at the free end, contrary to a K-shaped welded seam which requires a cut with three sides. This results in the production methods being able to be simplified, for example by producing a cut out in a V shape and two corresponding welded seams, rather than two oblique cut outs and a cut out perpendicular to the longitudinal axis to define three welded seam strips.

In a preferred option, the pouch is provided with at least one connection port for the filling and/or the emptying, formed exclusively in one from among the first wall element and the second wall element.

The join portion is typically flat and has, opposite a narrower free end, a rectilinear base, wider, which extends transversally from one to the other of the folding lines of the first and second gussets. The join portion can furthermore remain flexible and be folded, at least in the substantially parallelepiped configuration, around a folding line defined by the rectilinear base and/or by shaping in a C shape, in a transversal cross-sectional plane of the join portion.

By the arrangement of the join portion, a larger zone is arranged to interconnect the films, and the pouch has a sufficiently robust welded end during the filling and the transportation. It is understood that this advantageously makes it possible, cumulatively:

to simplify the operations with respect to the production of a K-shaped welded seam, by removing the transversal welded seam and possibly the transversal cut out;

to reduce the risk of rupture at the connecting end where all the films constituting the pouch join together; and to carry out the filling in a parallelepiped volume which is suited to the transportation stresses, the ability with folding the join portion which is flat and robust, making it possible for the flexible pouch to be received in the same type of tank or other rigid container as a pouch having a K-shaped welded seam.

According to a particularity, the two oblique edges are:

a first rectilinear edge defined by two of the side edges which
- are welded to one another in the join portion,
- while being separated outside of the join portion by each being welded to the first gusset;

a second rectilinear edge defined by two others of the side edges which
- are welded to one another in the join portion,
- while being separated outside of the join portion by each being welded to the second gusset.

According to a particularity, in the flat configuration, the two folding lines are separated by a transversal space which is typically constant.

According to a particularity, in the flat configuration of the 3D flexible pouch, the folding line of each gusset is rectilinear and of length less than at least 25 mm at the maximum extension of the flexible pouch measured along the longitudinal axis in the flat configuration.

According to a particularity, the join portion is triangular, the respective side edges of either of the first and second wall elements each comprising an intermediate rectilinear section which extends between a first mainly rectilinear section and a second section, and being furthermore suitable for:

defining, by the respective intermediate section, four rectilinear edges of the flexible pouch which are parallel to one another both in said flat configuration and in said substantially parallelepiped configuration;

defining, by the parts of the first non-welded sections at the first and second gussets, two sides of identical length of the join portion.

In various embodiments of the flexible pouch, furthermore, one or more of the following arrangements can possible be resorted to:

the first wall element and the second wall element have one same longitudinal dimension which is greater than a maximum longitudinal dimension respectively of the first gusset and of the second gusset.

the first wall element and the second wall element have one same hexagonal shape and mainly identical dimensions.

the films respectively constituting the first wall element and the second wall element are welded to one another, to the other of the two opposite ends, so as to define an additional join portion of the side edges which project axially towards the outside with respect to the first and second gussets in the flat configuration.

the additional join portion, preferably triangular, is defined by the parts of the two non-welded sections at the first and second gussets.

the first gusset and the second gusset are each in a state, folded in two, in the flat configuration, by being folded towards the inside along a rectilinear folding line parallel to the longitudinal axis.

a connection port is placed in a flap defined by the first wall element, on the join portion side and with a clearance with respect to the join portion.

According to a particularity, the flexible pouch comprises:

two first flaps of which one forms part of the first wall element and the other forms part of the second wall element, the two first flaps being connected to one another by the join portion and forming, combined with the zones of the first and second gussets adjacent to the two first flaps, an outer face of the flexible pouch in the parallelepiped configuration, the join portion projecting from the outer face towards the outside in the parallelepiped configuration.

According to another particularity, it is furthermore provided, two second flaps of which one forms part of the first wall element and the other forms part of the second wall element, the two second flaps being connected to one another by the additional join portion by forming, combined with the zones of the first and second gussets adjacent to the two second flaps, another outer face of the flexible pouch in the parallelepiped configuration, the additional join portion projecting from the outer face towards the outside in the parallelepiped configuration.

According to an option, the films which respectively constitute the first wall element, the second wall element, the first gusset and second gusset are welded by together defining in the flat configuration:

four continuous side welded seams which extend parallel to the longitudinal axis in the flat configuration;

four first continuous oblique welded seams which each extend from a determined end of one of the side welded seams up to the join portion.

According to a particularity, the films which respectively constitute the first wall element, the second wall element, the first gusset and second gusset are welded so as to furthermore define in the flat configuration:

four second continuous oblique welded seams which each extend from an end opposite the determined end of one of the side welded seams up to the additional join portion.

Optionally, each of the welded seams has a minimum width at least equal to 5 mm. This makes it possible to make the pouch particularly robust and capable of undergoing severe transportation stresses, in particular external pressure modifications (for example, because of air transportation).

According to a particularity, each of the films respectively constituting the first wall element, the second wall element, the first gusset and the second gusset locally has, along the welded seams, a thickness which is not less than the average thickness of said films, this average thickness being between 150 and 450 μm for each of these films.

The free end of the join portion defines an angle of between 60 and 100°, preferably between 80 and 95°, which corresponds both to:

the angle between the two oblique edges in the flat configuration; and the angle between the first oblique welded seams, respectively connecting between the first and second gussets and the first and second wall elements, in the flat configuration.

The films respectively constituting the first wall element, the second wall element, the first gusset and the second gusset:

are each composed of at least three plastic, non-metal layers, and are preferably transparent or translucid; and/or each have a thickness of between 150 micrometers and 450 micrometers and a resistance to traction of between 60 and 220 Newtons.

According to a particularity, the first gusset and the second gusset each have:

an inner, hot-weldable layer; and an outer, hot-weldable layer, made of a material selected from among polyethylene, polyamide, ethylene-vinyl acetate copolymer, polyamide and ethylene poly terephthalate.

According to a particularity, in the parallelepiped configuration:

the maximum transversal extension of each of the first and second gussets is at least 15 cm between the first wall element and the second wall element; and the flexible pouch makes it possible to define an inner space at least equal to 2 L, preferably at least equal to 5 L.

According to a second aspect, a method for producing a 3D flexible pouch according to the invention is proposed, to fill with a biopharmaceutical product, method in which the following are unwound along a longitudinal scrolling direction:

a first wall element provided with two side edges, consisting of a film and making it possible to define a front face, a second wall element provided with two side edges, consisting of a film and making it possible to define a rear face, a first gusset and a second gusset, each constituted by a film cut out from one piece and defined by two longitudinal edges, knowing that each from among the first gusset and the second gusset is inserted in a state, folded in two around a longitudinal folding line, between the first wall element and the second wall element, the first gusset and the second gusset being arranged with a transversal space against one another;

the method further comprising steps which mainly consist of:

producing a cut out in a V shape to define sections of side edges and sections of longitudinal edges which are oblique with respect to a longitudinal axis of the pouch in an empty flat configuration, such that a tip of the cut out in a V shape are defined only by the first wall element and the second wall element (no film of the gussets being present in this tip) in an intermediate zone situated, in the empty flat configuration, between a first virtual straight line coinciding with the longitudinal folding line of the first gusset and a second virtual straight line coinciding with the longitudinal folding line of the second gusset;

producing welded seams at the level of the respective longitudinal edges, in order to connect in a sealed manner, the first gusset and the second gusset between the first wall element and the second wall element;

producing a welded seam in a zone, adjacent or corresponding to the tip of the cut out in a V shape, in order to directly connect in a sealed manner, the first wall element to the second wall element, the cut out in a V shape and the welded seams being made such that the pouch can be filled with a biopharmaceutical product in a parallelepiped configuration of the flexible pouch.

The method thus advantageously makes it possible to minimize the number of cut outs with respect to a K-shaped connection which has a transversal welded seam, made perpendicularly to the longitudinal axis of the pouch.

According to a preferred option, the first wall element, the second wall element, the first gusset and the second gusset are defined by sheets having one same multilayer structure.

According to a particularity, four first oblique welded seams which converge towards the tip of the cut out in a V shape are made:

- by welding the oblique sections of the two longitudinal edges of the first gusset to the first wall element and to the second wall element, respectively to an oblique section of one of the side edges of the first wall element and to an oblique section of one of the side edges of the second wall element, this by which two first oblique welded seams are obtained; and
- by welding the oblique sections of the two longitudinal edges of the second gusset to the first wall element and to the second wall element, respectively to an oblique section of the other of the side edges of the first wall element and to an oblique section of the other of the side edges of the second wall element, by which two other first oblique welded seams are obtained.

The method can include an additional step for cutting out in a V shape, to obtain a second tip, axially opposite the first tip. The second tip is typically also defined between the first virtual straight line coinciding with the longitudinal folding line of the first gusset and the second virtual straight line coinciding with the longitudinal folding line of the second gusset.

According to a particularity, a welded seam is made in an adjacent zone or in a zone corresponding to the second tip, in order to directly connect in a sealed manner, the first wall element to the second wall element (opposite the first tip).

Four second oblique welded seams, similar to the first oblique welded seams, can be made so as to converge towards the second tip in the empty, flat configuration.

According to a particularity, the transversal space between the first gusset and the second gusset makes it possible to form, between the folding lines, a determined line which defines a base of the join portion, the deformation of these gussets making it possible to obtain a parallelepiped configuration wherein the folding line of each of the gussets is U-shaped and tangentially joins the determined line (tangential join at an end of the folding line in question).

According to a particularity, it is provided in the method to insert, exclusively in one from among the first wall element and the second wall element, a connection port making it possible to connect a flexible supply duct.

According to an option, the cut out in a V shape is made at two opposite ends of the pouch, such that the first wall element and the second wall element have a hexagon-shaped perimeter in the flat configuration, while the first gusset and the second gusset have a hexagon-shaped perimeter in the flat configuration.

BRIEF DESCRIPTION OF THE DRAWINGS

Other characteristics and advantages of the invention will appear during the following description of several embodiments, given as non-limiting examples, opposite the appended drawings wherein.

DETAILED DESCRIPTION

Below, a detailed description of several embodiments of the invention accompanied by examples and reference to the drawings.

In the different figures, identical references indicate identical or similar elements.

Figure 1A:
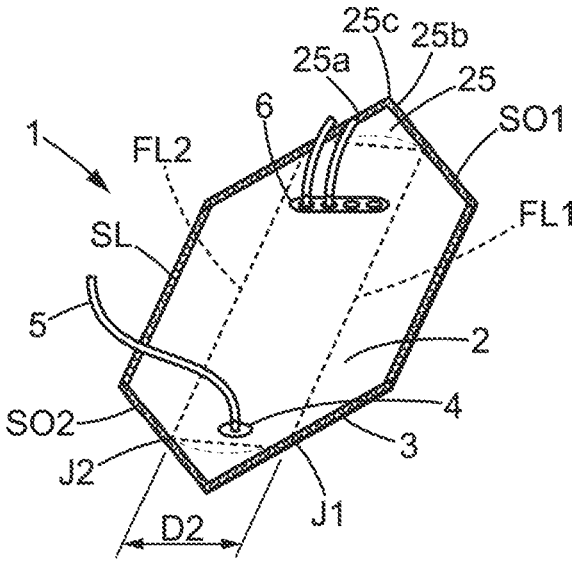
FIGS. 1A and 1B are perspective views, representing, according to a first embodiment, a 3D flexible pouch before a filling with a biopharmaceutical fluid.
Figure 1B:
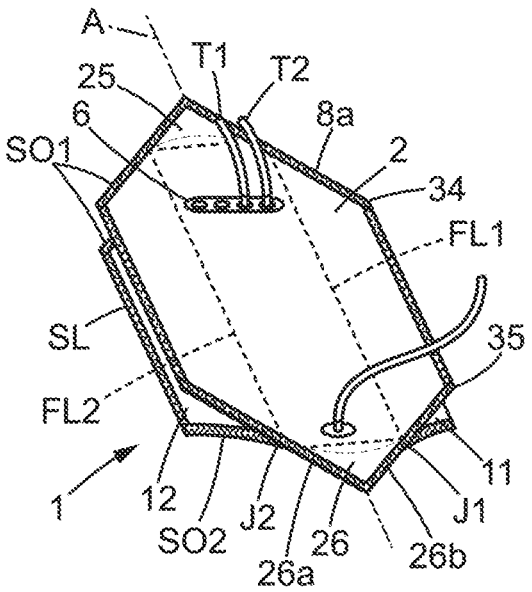
Figure 2:
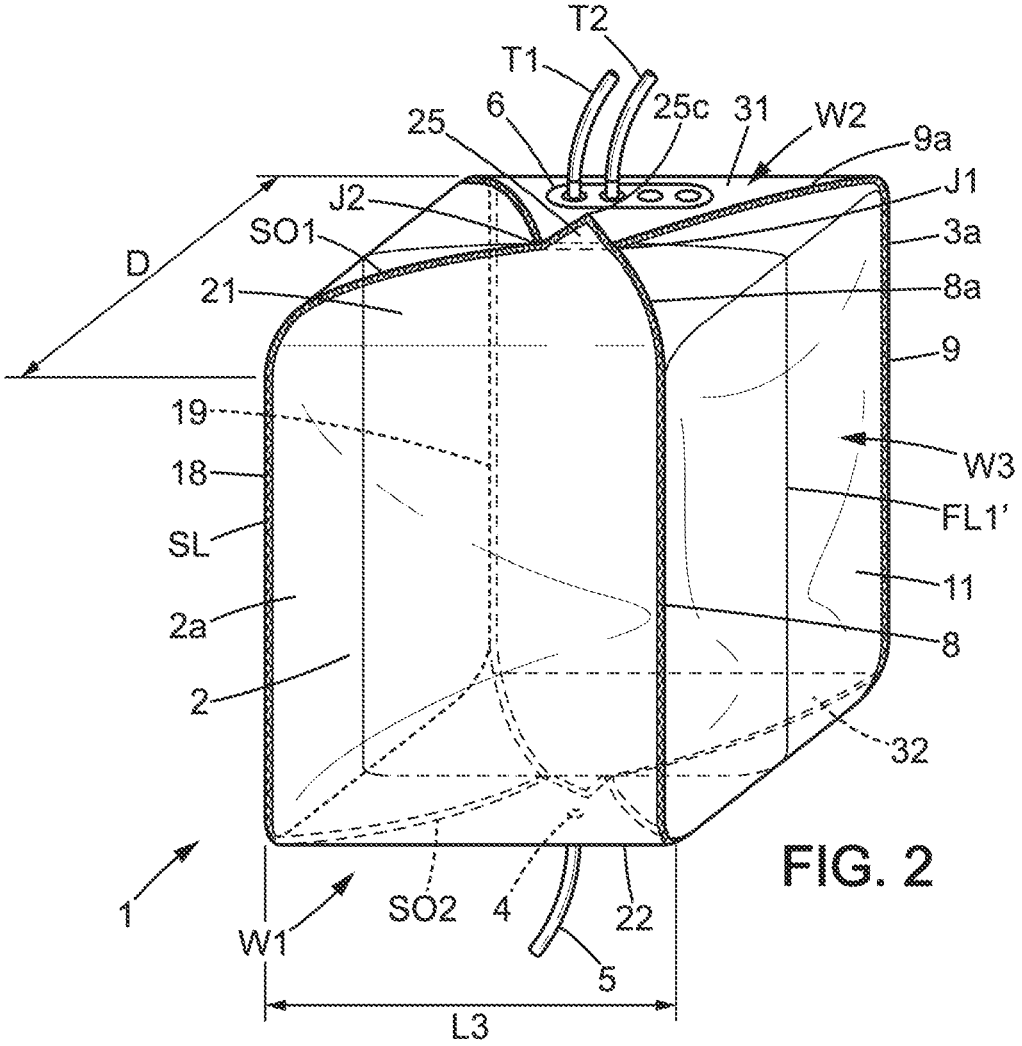
FIG. 2 is a perspective view of the 3D flexible pouch of FIGS. 1A-1B, in the deployed state and filled with a biopharmaceutical fluid.

As can be seen in FIGS. 1A and 1B, the flexible pouch 1 which is deployed in three dimensions, can have a flat configuration, wherein two opposite wall elements 2, 3 define two main outer faces, opposite the flexible pouch 1. It can be seen that this flexible pouch 1 has connection ports for the filling and/or the emptying. Here, the connection port 4 can make it possible to connect, according to a non-limiting example, a flexible pipe 5 to carry out an emptying. In this case, and as illustrated in FIG. 2, when the flexible pouch 1 and in a deployed, parallelepiped configuration, this connection port 4 of the flexible pouch 1 of 3D type extends in a first end face W1. According to an option, one or more connectors 6 forming connection ports are provided here on the second end face W2 opposite the connection port 4, to make it possible for the filling of the flexible pouch 1 (with typically several inlet or supply openings).

Generally, at least one flexible supply duct is provided to make it possible to fill the 3D flexible pouch, via a connection port. Here, the flexible pipes T1, T2 associated with the connectors 6 are of a type known per se. The flexible side wall W3 which can be seen in FIG. 2 has predefined folds, in particular folding lines FL1 and FL2 formed in the gussets 11, 12 during the design of the flexible pouch 1, which facilitates a correct unfolding, as the filling level, typically with a biopharmaceutical fluid, increases.

Of course, the position of the connection port(s) 4, 6 can vary, preferably by making openings on one (preferably only one) of the wall elements 2 and 3. These connection ports 4, 6 are placed at a distance from the connection zones between the two wall elements 2 and 3 and they do not interfere with the unfolding of the gussets 11 and 12 of the flexible pouch 1 of 3D type. The connection ports 4, 6 can be closed in a sealed manner in a manner known per se (in the example of FIG. 10, the ports are connected in a sealed manner to a tube length of pipe T1, T2 itself blocked, in a sealed manner, by a clip generally called a "clamp" (C1, C2) by a person skilled in the art, an aseptic connector, or could include valves or one-way valves or other similar sealed closing systems).

Figure 3:
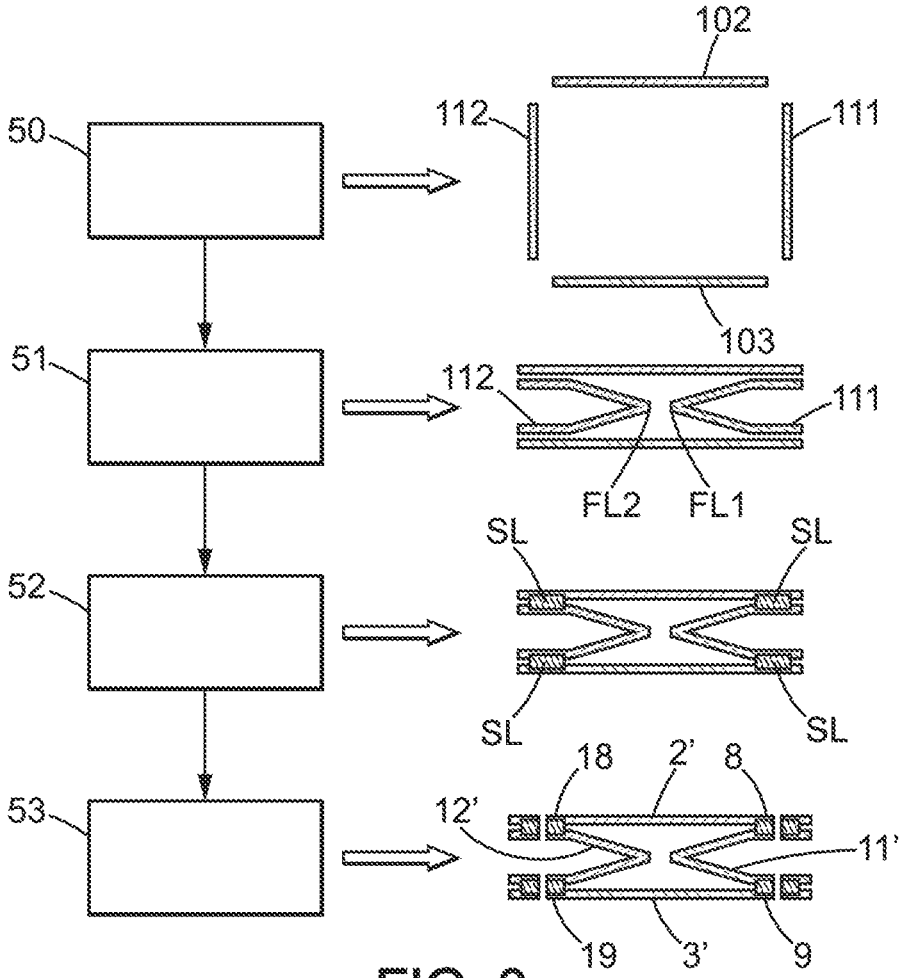
FIG. 3 shows a flowchart of steps representing steps of assembling and trimming four films constituting the 3D flexible pouch.
Figure 8:
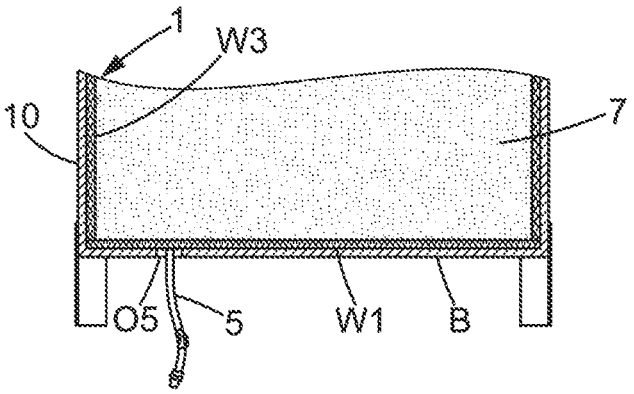
FIG. 8 is a side view showing the bottom of a 3D flexible pouch in the filled state and received in a storage device.

FIG. 8 illustrates an application example of the flexible pouch 1. Here, the bottom defined by the first end face W1 is adhered to the base part B of a storage device 10, which could make it possible, if necessary, the transport the flexible pouch 1 of 3D type in the filled state. The flexible pipe 5 to carry out the emptying is thus capable of passing through an orifice O5 situated in the base part B of the storage device 10. This cooperation with an orifice O5 makes it possible to position the first end face W1 of the flexible pouch 1. In practice, the flexible pouch 1 can be placed in the inner volume of such a storage device 10 before a step of filling with biopharmaceutical fluid. The inner volume of the device 10 is accessible through an upper transversal opening, and possibly accessible using side doors. FIGS. 1 and 3 of document WO 2015/118269 illustrate this type of storage device.

The increase of volume of the flexible pouch 1 can be done by minimizing the risk of forming incorrect folds in the face W1. The side wall W3 can also swell without any impediment and without any incorrect fold to pass from an extreme state (fully flat) and to another extreme state (by defining a parallelepiped volume), by resting on the inner face of the storage device 10. This type of storage device 10 can be presented in the form of a rigid container, possibly with a stack possibility.

This is, in the case of FIG. 8, of an application for large volumes which reach or exceed 15 or 20 liters. This is the reason why, it is, in practice, necessary to ensure the outer holding of the flexible pouch 1, once filled with content. Certain rigid containers are also used for the transportation, while others are more particularly suitable for making a weighing possible. The holding of a flexible pouch 1 of 3D type by the outside, in a rigid structure for receiving and holding for storage being known per se, it will not be described further here.

In the specific embodiment of FIGS. 1A-1B and 2, it is understood that the connection port(s) 4, 6 can be placed exclusively in one flap 22 or two flaps 21, 22, defined by the first wall element 2, optionally in the proximity of a join portion 25 by welding between the two wall elements 2 and 3 of the flexible pouch 1 without passing through such a join portion 25. This type of configuration is suitable, in particular, to place the flexible pouch 1 of 3D type, in a storage device 10 without side access to the inner volume.

In reference to FIG. 2, the maximum extension of each gusset 11, 12 caused by the filling, makes it possible to spread the first wall element 2 from the second wall element 3 by a distance D at least equal to 12 or 15 cm, and preferably at least equal to 40 or 50 cm for storage applications in the device 10. It is thus permitted to contain, in such a flexible pouch of 3D type, a volume of biopharmaceutical product of at least 2 liters, and preferably of at least 5 liters. In the parallelepiped configuration of the pouch 1, it is understood that the distance D can correspond to a substantially constant clearance between the front face 2*a* defined by the first wall element 2 (face 2*a* situated between the flaps 21 and 22) and the rear face defined by the second wall element 3 (face 3*a* situated between the flaps 31 and 32).

Examples of functional, multilayer films making it possible to constitute the wall elements 2, 3 and the gussets 11, 12 of the flexible pouch 1 are known, in particular in document US2012/028039 from the same applicant. These films make it possible to obtain a great flexibility coupled with a satisfactory resistance, which facilitates the unfolding of the gussets 11, 12 without any risk of a swelling (during the filling) in the first end face W1 or in the side wall W3 do not cause a rupture of the film.

The first wall element 2 is typically a flexible part consisting of a multilayer film and making it possible to define a front face 2*a* of the flexible pouch 1, while the second wall element 3, made similarly or identically (through a multilayer film) is a flexible part making it possible to define a rear face 3*a* of the flexible pouch 1, as can be seen in FIGS. 1A, 1B and 2. The gussets 11 and 12 can have a similar material and a similar thickness (preferably identical) to what is provided for the wall elements 2 and 3. It is understood that the gussets 11 and 12 are constituted by respective films cut out from one part, the cut out could occur before, during or after the step of connecting with the wall elements 2 and 3.

Advantageously, for a filling with a biopharmaceutical fluid 7, the inner layer of each of the films which compose the flexible pouch 1 is made of a plastic, hot-weldable material, and biocompatible with transported environments. In a preferred embodiment, each film has a multilayer structure. This multilayer structure can be broken down, for example, into three layers which are typically plastic, non-metal layers. As a non-limiting example, the film can be transparent or translucid.

In a preferred embodiment, the first gusset 11 and the second gusset 12 each have:

- an inner, hot-weldable layer, forming the contact layer 16; and
- an outer, hot-weldable layer, made of a material selected from among polyethylene (preferably with low linear density, or possibly high linear density), polyamide, ethylene-vinyl acetate copolymer, polyamide and ethylene poly terephthalate.

Figure 11:
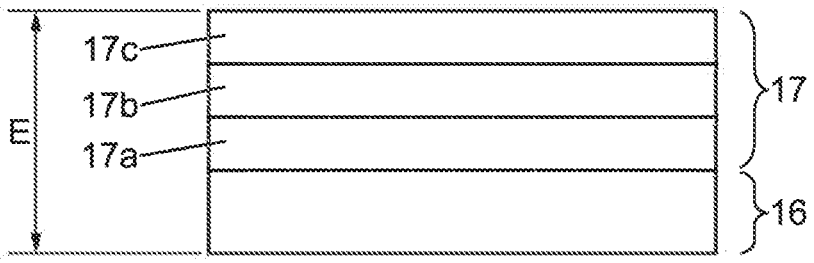
FIG. 11 represents an example of a composition of films constituting the flexible pouch, according to the invention.

In order to improve the mechanical resistance of the flexible pouch 1, each of the films 102, 103, 111, 112 can have an assembly 17 of functional layers, superposed on a contact layer 16. In reference to FIG. 11, an outer face can be provided, made of PET by the outer layer 17*c*. This material which typically has a semi-crystallinity gives a good resistance vis-à-vis the oxygen from air (chemical resistance), a low water absorption rate and thus makes it possible for long-term storage applications. The thickness of the outer layer 17*c* can be particularly low, for example of between 7 and 50 μm, preferably between 10 and 30 μm. In a variant, a high linear density polyethylene or other thermoplastics (in particular, polyamide) can be provided, which are easily weldable and sufficiently hard to improve the resistance of the assembly.

The contact layer 16 (inner layer) is typically hot-weldable and can consist of a layer of material compatible with biological materials without no deterioration effect. Polyethylene, in particular low linear density polyethylene, is a preferred example of material to constitute the contact layer 16, as it accumulates the advantages of compatibility with the biopharmaceutical fluid 7 and of good weldability. Other materials with similar properties can be used, for example, ethylene-vinyl acetate copolymer.

An intermediate layer 17*a* can correspond to the layer with a barrier effect to gases (particularly vis-à-vis dioxygen and carbon dioxide present in ambient air). In certain options, one or two layers of gluing material (glue layers) can be provided on one side and/or the other of the barrier-effect layer.

Another intermediate layer 17*b* can consist of polyamide (PA), which improves the resistance to impacts (mechanical resistance). Here, as a non-limiting example, the intermediate layer 17*b* for the mechanical resistance is placed between the outer layer 17*c* and the layer 17*a* with a barrier effect to gases. Because of the lesser resistance of the layer 17*a* with a barrier-effect to gases, this can be placed advantageously between the contact layer 16 and the other layers 17*b*, 17*c* of the assembly 17. The composition of the multilayer film represented in FIG. 11 can be used for all the films 102, 103, 111, 112 of the flexible pouch 1 of 3D type. Such a composition can make it possible to limit the thickness E to less than 450 μm, for example of around 200 or 400+/−50 μm. The thickness E can possibly be reduced to around 100+/−30 μm, for example for applications without hermetic closing of the flexible pouch 1.

In a variant, only three layers can be used and an assembly 17 can be defined in two layers with more flexibility. For this, the layers 17*b* and 17*c* are replaced by a single polyethylene layer, preferably low linear density polyethylene. In this case, it is preferable to define a thicker contact layer 16 than in the example illustrated, such that the thickness E is of around 400+/−50 μm, as a non-limiting example. The material of the contact layer 16 can also be made of low linear density polyethylene.

The films preferably have three layers and have a resistance to traction, typically greater than 60 or 80 Newtons. This resistance to traction can generally be of between 60 and 220 Newtons. The flexible pouch 1 is thus particularly difficult to degrade.

The extension to the rupture, which defines the capacity of each of the films to be extended before breaking (in response to a traction test), is for example greater than or equal to 80%, but less than or equal to 400% or 500%. It is understood that the flexible pouch 1 has physical and mechanical properties suitable for the deployment from a flat-folded state to a parallelepiped deployed state, which remove, in practice, the risk of accidental tearing.

The first wall element 2 and the second wall element 3 can have a structure, similar or identical to that of the gussets 11, 12. An intermediate layer, for example having a barrier effect (for example, EVOH-based or equivalent material-based), can be provided in the multilayer structure of the elements 2, 3, 11, 12 defining the volume of the flexible pouch 1. The multilayer structure can be broken down into at least three plastic, non-metal layers, and is preferably transparent or translucid.

Now in reference to FIG. 1A, it can be noted that the gussets 11 and 12 are spaced apart from one another by a transversal space D2. This transversal space D2 corresponds to a typically constant distance.

The folding lines FL1 and FL2 for the first gusset 11 and the second gusset 12 are thus rectilinear and parallel to the side edges 8, 18 and 9, 19 defined by the wall elements 2 and 3. It can be seen that the folding lines FL1 and FL2 extend on either side of the longitudinal axis A (in this case, a central axis, as can be seen in FIG. 1B) of the flexible pouch 1 in the flat configuration.

Figure 9:
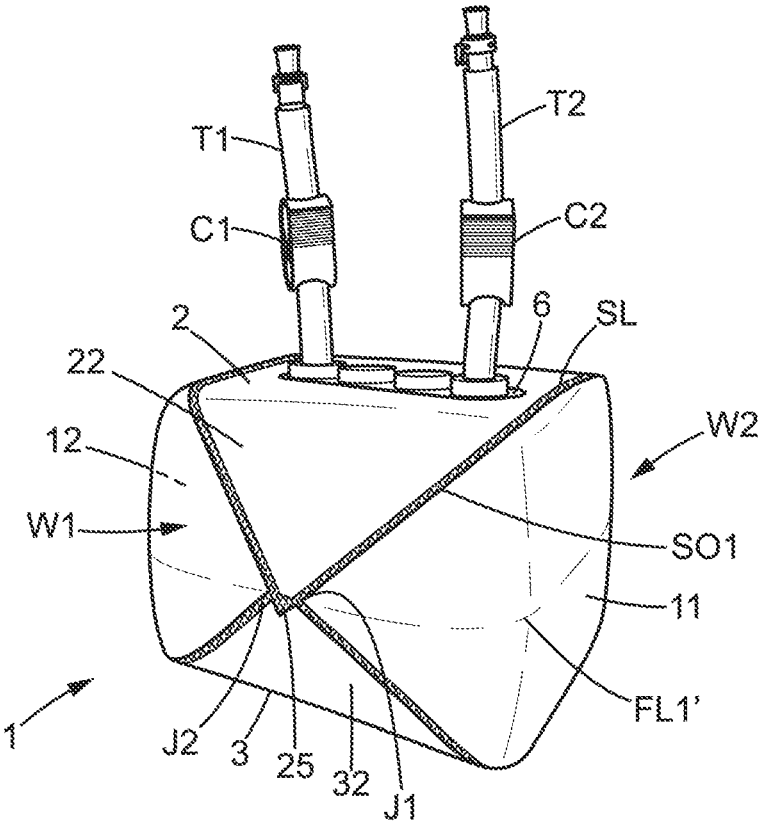
FIG. 9 is a perspective view of a 3D flexible pouch with an arrangement of the connection ports in a central zone of a wall element, between two flaps of this wall element.

In reference to FIGS. 2 and 9 which represent a flexible pouch 1 in a state filled with biopharmaceutical fluid, the first gusset 11 is connected to two side edges 8 and 9 on either side of the first and second wall elements 2 and 3. Similarly, the second gusset 12 is connected to two other side edges 18 and 19 on either side of the first and second wall elements 2 and 3. The connection to the side edges 8, 18 of the first wall element 2 and to the side edges 9, 19 of the second wall element 2 produced by a direct welded seam by thus securing the margin zones of the gussets 11 and 12 which go along the side edges 8, 9, 18, 19. Below, these margin zones will be called longitudinal edges.

Figure 4:
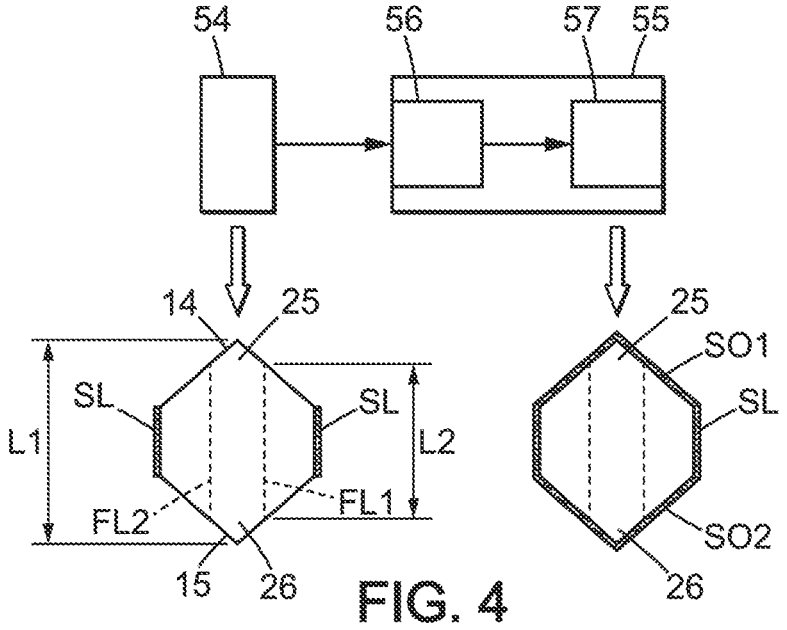
FIG. 4 schematically illustrates steps making it possible to obtain two axial ends, each defined by two oblique edges.

The first gusset 11 and the second gusset 12 can each be folded along the folding line FL1 and FL2 thereof, towards the inside. In this example, the folding is done in two equal halves for each gusset 11, 12, at least in the flat configuration of the flexible pouch 1. Each folding line FL1, FL2 extends between two opposite axial ends 14, 15 of the flexible pouch 1, as can be seen in FIG. 4, for example.

In reference to FIG. 2, the passage to the filled configuration, with a parallelepiped geometry, is permitted by a narrowing of each gusset 11, 12 in the direction of extension of the folding line FL1 or FL2, because of the swelling towards the outside of the side wall W3. At the same time, the respective side edges 8, 9, 18, 19 are folded to form the flaps 21, 22, 31, 32. A section FL1' of the folding line FL1 is moved towards the outside in the course of the filling with biopharmaceutical fluid.

In reference to FIGS. 1A, 1B and 2, it is provided to weld the side edges 8, 9, 18, 19 respective to the gussets 11 and 12, so as to form four continuous welded seam strips. There are thus, in the side wall W3, four continuous side welded seams SL forming four edges parallel to the pouch 1 in the parallelepiped configuration. In the fully filled state, the section FL1' can extend parallel to these four side welded seams SL and it is the same for a section opposite the folding line FL2. In the flat configuration, the four side welded seams SL extend parallel to the longitudinal axis A and are extended by four first continuous oblique welded seams SO1. In this example, the four first oblique welded seams SO1 each extend from a determined end 34 of one of the side welded seams SL up to the join portion 25. The flexible pouch 1 can furthermore have four second oblique welded seams SO2 which each extend from the other end 35 of a side welded seam SL.

The join portion 25, common to the four side edges 8, 9, 18, 19, here has a generally triangular shape and has a base which extends between a first intersection J1 where the side edges 8 and 9 join together, welded to the first gusset 11 and a second intersection J2, where the side edges 18 and 19 join together to the second gusset 12. The intersections J1 and J2 coincide with two peaks of the triangular shape presented by the join portion 25. In the flat configuration, the join portion 25 projects axially towards the outside with respect to the first and second gussets 11, 12. Here, it is defined externally by two edges 25*a*, 25*b*, which are oblique with respect to the longitudinal axis A, which is produced by the cut out of the respective side edges 8, 9, 18 and 19. Indeed, the first wall element 2 and the second wall element 3 have one same general polygonal shape, here hexagonal, in the flat configuration of the pouch 1. In this case, the side welded seams SL each extend between:

- one of the first oblique welded seams SO1 which join together at a first axial end (each first oblique welded seam SO1 moving away from the other first oblique welded seams in the parallelepiped configuration up to reaching the determined end 34 of the side welded seam);
- and, on the side of the end 35, a continuous, oblique welded seam from among four oblique welded seams SO2 which join together at the other axial end.

In a variant, this general shape can be pentagonal or heptagonal, while conserving the four first oblique welded seams SO1.

Preferably, the dimensions of the first wall element 2 and of the second wall element 3 are mainly identical. The first gusset 11 and the second gusset 12 can also have identical dimensions in a preferred option.

The four first oblique welded seams SO1 make it possible, for example, to define the oblique edges 25*a*, 25*b* of the join portion 25. In the options with a general hexagonal shape of the first and second wall elements 2, 3, an additional join portion 26 is formed by also being defined by two oblique edges 26*a*, 26*b*, as can be seen in FIG. 1B, for example. From the intersections J1 and J2, the welded seams are extended towards a free end of the join portion 25, 26, despite the absence of any layer belonging to the gussets 11, 12. The welded seam in the join portion(s) 25, 26 makes it possible to connect the first wall element 2 to the second wall element 3, directly and in a sealed manner.

In reference to FIG. 1A, it can be seen that the join portion 25 is flat and has, opposite the narrower free end 25*c*, a base which is rectilinear and wider, which extends transversally from one another of the folding lines FL1, FL2 of the first and second gussets 11, 12. In the join portion 25, the two oblique edges 25*a*, 25 form an angle at the free end 25*c*.

In the flat configuration illustrated in this FIG. 1A, the two oblique edges 25*a*, 25*b* approach one another as the free end 25*c* is approached and are each extended, opposite the free end 25*c*, rectilinearly by the sections of the side edges 8, 9, 18, 19. This is produced because the pouch is cut out in a V shape, by defining the four first oblique welded seams SO1 which are rectilinear in the flat configuration. In the parallelepiped configuration, the oblique edges 25*a*, 25*b* are not subjected to the effect of the deployment of the gussets 11, 12, such that they can be kept projecting with respect to the second end face W2 which is formed by the folding of the remainder of the first oblique welded seams SO1.

Figure 6:
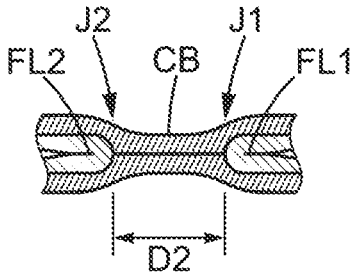
FIG. 6 is a cross-sectional view showing the arrangement of the four films on the side of a base of the triangular join portion, in a preferred embodiment of the invention.

FIG. 6 illustrates a cross-sectional detail of a flexible pouch 1 in flat configuration. This detail shows more specifically the central welded seam portion CB made directly between the inner faces of the wall elements 2 and 3 in the join portion 25, here at a certain distance from the free end 25*c* (in a contact zone with the gussets 11, 12, separate from the part which projects axially towards the outside with respect to the gussets 11, 12). The configuration of the join portion 25 makes it possible to cover, at the axial end 14, the transition zones between the folding lines FL1 and FL2 and the central welded seam portion CB, which limits the risk of losing sealing. Indeed, the layers defined by the first wall element 2 and the second wall element 3 are the only ones to define the oblique edges 25*a*, 25*b*, such that they cover the folded layers of the gussets 11, 12 on the three exposed sides towards the outside (these three sides are, for example, the front, the rear and the top).

Figure 10:
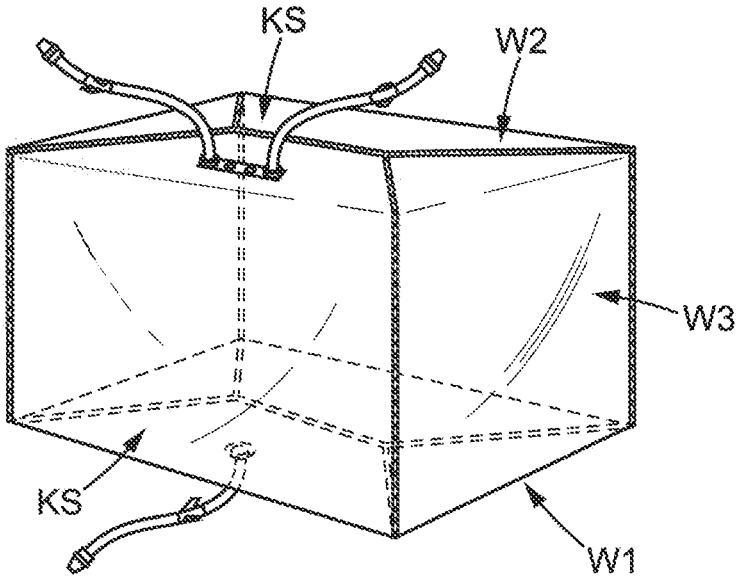
FIG. 10 (PRIOR ART)
FIG. 10 is a perspective view of a 3D flexible pouch according to the prior art.

The join portion 25 of general triangular shape, which axially covers the gussets 11, 12 is absent in conventional 3D flexible pouches (see FIG. 10), which have a K-shaped welded seam (welded seams KS in the case of FIG. 10). In reference to FIGS. 6 and 7, it is understood that torsions or other mechanical stresses which would be sufficient to locally separate the gusset along the intersections J1, J2 in the case of the pouch of FIG. 10, can no longer be troublesome when a join portion 25 axially covers the transition zones of four layers with two layers. In particular, the welded seam(s) in the join portion 25 have a protective effect on the most fragile transition zones, more specifically the zones formed at the narrow end, folded into two of the gussets. The risk of leakage is thus limited. The join portion 25, because of the flexibility thereof, can slightly arch and bend by forming a C-shaped section, but by better distributing the torsion stresses because of the axial extension of the central welded seam portion CB towards the free end 25*c*.

Figure 7:
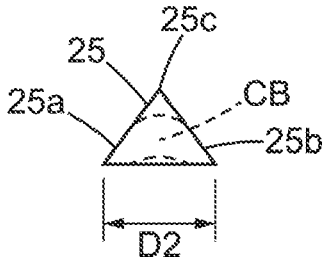
FIG. 7 illustrates an example of a welding zone used to produce a sealing in the triangular join portion, between the first wall element and the second wall element.

The inner faces of the first and second wall elements 2, 3 are preferably defined by a specific hot-weldable layer (layer on the inner side for the contact with the biopharmaceutical fluid) of a multilayer structure. As a non-limiting example, the central welded seam portion CB can be triangular, in a V-shape, with a curve as illustrated in FIG. 7 or without a curve. The maximum extension of the central welded seam portion CB (along the extension direction of the projecting strip) can be equal to the transversal space D2 between the first gusset 11 and the second gusset 12 in the flat configuration.

Of course, the protective effect can be reproduced opposite, by the additional join portion 26.

In reference to FIG. 4, it can be provided to produce one or two cut outs in a V shape at the opposite ends 14, 15, if necessary, by simultaneously producing at least two or four of the oblique welded seams SO1, SO2. Although FIG. 4 illustrates the case of a cut out made before obtaining the oblique welded seams SO1 and SO2, it is also permitted in a variant of defining the ends 14 and 15 of the flexible pouch 1 subsequently, the oblique edges 25*a*, 25*b*, 26*a*, 26*b* being obtained in this case by a step of cutting out, subsequent to the sealing of the films.

In reference to FIG. 2, the flexible pouch 1 of 3D type has, for a fully deployed/filled state, which corresponds to the parallelepiped configuration:

- on the side of the second end face W2, two first flaps 21, 31 of which one forms part of the first wall element 2 and the other forms part of the second wall element 3; and
- on the side of the first end face W2, two second flaps 22, 32 of which one forms part of the first wall element 2 and the other forms part of the second wall element 3.

The first flaps 21, 31, on the one hand, and the two second flaps 22, 32 are made directly contiguous by the corresponding join portion 25, 26. This tips are formed, here in a general triangular shape, to each of the opposite ends 14 and 15.

By comparing FIG. 2 to FIG. 10 which represents a 3D flexible pouch of an existing type, it can be seen that each of the end faces W1 and W2 shown in FIG. 2 has a projecting join portion 25, 26, in particular projecting further towards the outside, whichever projecting strip could be defined in the face in question W1 or W2 by a welded seam between a gusset 11, 12 and a wall element 2, 3.

Here, in the case of FIG. 2, these are the oblique welded seams SO1, completed, if necessary, by a central welded seam portion CB in the join portion 25 which make it possible to shape the join portion 25 projecting axially (by extending the welding zone) while forming the intersection between four projecting strips. The welded zones are more rigid than the parts of the non-welded parts, however by conserving a deformable/foldable character which makes it possible at least to fold the flaps 21, 22, 31, 32.

Preferably, each projecting strip defined by the oblique welded seams SO1, SO2 has:

- a maximum thickness which is around four times greater than the thickness E (FIG. 11) in the flexible zones of the flexible pouch 1 making it possible to make the inner volume of the pouch 1 vary; and a minimum thickness which is around twice greater than the thickness E in the flexible zones of the flexible pouch 1 making it possible to make the inner volume of the pouch 1 vary.

As can be seen in FIG. 9, the connection port(s) 4, 6 can be placed differently, preferably by making opening on one (preferably only one) of the wall elements 2 and 3. In this example, the connection port 6 is placed between two flaps 21, 22 of the first wall element 2, at a distance from the side welded seams SL.

Alternatively, the flexible pouch 1 can have the same general configuration with different connection ports, for example, to define a container of the collar type and making it possible for a stirring, as described in document EP 2 326 412 (see, in particular, FIGS. 1E to 1H and FIG. 2 in this document). Thus, the wall element 2 is found which is placed typically on the top and supports the collar (the opposite can be provided with the wall element 2 on the bottom). It is thus observed that, also when the flexible pouch 1 makes it possible for stirring/mixing applications, the connection port(s) is/are placed at a distance from the welded seams, on at least one of the wall elements 2, 3.

In embodiments, the joins between the flaps 21, 31 and 22, 32 produced by a local heating during a sufficiently long period of exposure (which can be of around a few seconds or possibly 10 seconds, for example) to the heat or to a heating by low-voltage electrical impulse (for example, up to 9 impulses), produced by a welding head. The technique of heating by a low-voltage electrical impulse can be used, such that the appearance of the visible face is unchanged, while guaranteeing a good welding quality: indeed, it does not quire any high pressure at the time of the welding.

Impulse welding, thermal welding or laser welding techniques can make it possible to obtain resistant welded seams SL, SO1, SO2.

Steps for producing a flexible pouch 1 according to the invention will now be described in reference to FIGS. 3, 4 and 5.

The step 50 of supplying and making available the four films 102, 103, 111 and 112 is typically permitted by using rollers (not represented) which unwind these films in one same general direction, called longitudinal scrolling direction. Of course, this direction, perpendicular to the cross-sections illustrated on the right of FIG. 3, is simply used as a reference point to explain the drawings and it is permitted, of course, to route the films with one or more changes of direction (no need for the transportation direction to correspond to a rectilinear layout).

In reference to FIGS. 3 and 4, an embodiment example of the side welded seams SL can be seen, which are formed along a longitudinal direction (longitudinal sense or direction which could correspond to the scrolling direction of the film strips) during the production of the flexible pouches 1. On the production line, the insertion of the gussets 11 and 12 can be done in a manner known per se (see in FIG. 3, the step 50 of supplying and making available the films 102, 103, 111 and 112, and the step 51 of folding the films 111, 112 towards the inside, intended to form the gussets 11, 12). To weld each gusset 11, 12, the corresponding film 111, 112 can be held supported against a guide having been used for folding or against an equivalent abutment element 40 (FIG. 5).

As illustrated by the non-limiting example of FIG. 3, the four side welded seams SL can simultaneously be made during a welding step 52 which makes it possible to assemble the four films 102 and 103 (first pair of films opposite one another), 111 and 112 (second pair of films opposite one another and routed transversally with respect to the first pair of films). The folding lines FL1 and FL2 are kept spread apart during this welding step 52 so as to already define the final transversal space D2 between the first gusset 11 and the second gusset 12 in the flat configuration.

The welded seam length can be longer than the final length of the side welded seams SL, in particular in the options which make it possible for oblique cut outs. The pair of films 102 and 103 makes it possible to form, after a cut out step 53, rectangular sheets 2', 3' from which the respective wall elements 2 and 3 can be obtained. In this non-limiting example, gussets 11', 12' are obtained, which are not also cut out obliquely and which can also be of the same length (along the scrolling direction) as the length L1 of the rectangular sheets 2', 3'.

The cutting step 53 can be optional. The material of the four films 102, 103, 111, 112 here is identical. More generally, it is understood that the first wall element 2, the second wall element 3, the first gusset 11 and the second gusset 12 are defined by rectangular sheets optionally having one same multilayer structure, with a layer defining an inner face suitable for the contact with a biopharmaceutical fluid 7.

In reference to FIG. 4, after an additional cutting step 54, here along a V-shaped cut out on the side of each end 14, 15, the gussets 11, 12 of reduced length L2 are obtained with respect to the length L1 (maximum length) of the wall elements 2 and 3. One same longitudinal direction L1 here is provided for the first wall element 2 and the second wall element 3.

It is understood, more generally, that the V-shaped cut out makes it possible to define the sections of the respective side edges 8, 9, 18, 19 and the sections of the longitudinal edges of the gussets 11, 12 which are oblique with respect to the longitudinal axis A of the pouch 1, such that a tip of the V-shaped cut out are defined only by the first wall element 2 and the second wall element 3 (only two film layers) in an intermediate zone. It can be seen in FIGS. 1A, 1B and 4, that this intermediate zone is situated, in the empty, flat configuration, between a first virtual straight line coinciding with the longitudinal folding line FL1 of the first gusset 11 and a second virtual straight line coinciding with the longitudinal folding line FL2 of the second gusset 12.

The triangular join portions 25, 26, produced by the V-shaped cut out and which project axially with respect to the gussets 11, 12 (shorter than the wall elements 2, 3), have an angle of between 60 and 120°, preferably around 90°, at the join of the oblique edges 25*a*, 25*b*. This angle, here defined at the free end 25*c*, also corresponds, in the flat configuration at the angle between the two first oblique welded seams SO1 on the side of the first gusset 11 and the two first other oblique welded seams SO1 on the side of the second gusset 12.

The pair of folded films 111 and 112 has thus permitted to form the first gusset 11 and the second gusset 12, and it only remains to complete the welded seams on either side of the side welded seams SL. For this, a step of producing sealing 55 is provided, during which the first oblique welded seams SO1 and optionally the two oblique welded seams SO2 are produced.

In this non-limiting example, the respective side edges 8, 9, 18, 19 are each decomposed into a first rectilinear section, a second section and an intermediate rectilinear section which extends between the first section being used to produce an oblique welded seam SO1 and the second section. The intermediate rectilinear section here is welded before the other sections to produce one of the side welded seams SL. In a variant, the second section can be removed, for example, if it is desired to produce a transversal straight lined welded seam of the same width as the films 102, 103, rather than the oblique welded seams SO2.

The respective side edges 8, 9, 18, 19 make it possible to define, by the respective intermediate sections, four rectilinear edges of the flexible pouch 1 which are parallel to one another, both in the flat configuration and in the substantially parallelepiped configuration, while the parts of the first sections not welded to the first and second gussets 11, 12 define two sides, of identical length, of the join portion 25. It can be seen in FIG. 2, that the first section 8*a* of the side edge 8, like all the other first sections, are decomposed into:

- a part welded to a gusset, here the first gusset 11, and
- an end part which forms one of the sides of the join portion 25 and is only welded to the first section 9*a* of the side edge 9.

Similarly, the end parts of the second sections not welded to the gussets 11, 12 define two sides, of identical length, of the join portion 26.

A first sub-step 56 can make it possible to produce the first oblique welded seams SOL here by producing two successive welded seams with a straight bar or with a welded seam produced by a V-shaped welded seam device which can possibly be more or less curved and more or less expanded in the connection zone of the two arms of the welding device corresponding to the join portion 25. It can be preferred to locally increase the welding zone for the connection between the side edges 8, 9, 18, 19 of the wall elements 2 and 3, as can be seen in FIG. 7.

A second sub-step 57 can make it possible to produce the second oblique welded seams SO2, similarly to sub-step 56. Here also, it can be preferred to locally increase the welding zone for the connection between the side edges 8, 9, 18, 19 of the wall elements 2 and 3, in the join portion 26.

Of course, the V-shaped cut out could, in a variant, be produced only on the side of one of the ends 14, 15.

It is permitted to modify the order between some of the abovementioned steps, for example if it is desired to produce oblique welded seams before proceeding with cut outs through (obliquely) the scrolling direction. Generally, the action of cutting an already-welded zone is preferred when it is wanted to avoid difficult operations of holding already-cut borders in position, in order to weld them to one another, without any offsetting. Nothing also prevents producing a cut out during a welding operation.

Figure 5:
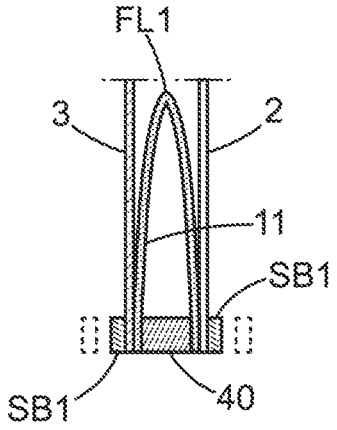
FIG. 5 is a detailed, cross-sectional view illustrating an example of a welding step between a welded seam and the adjacent wall elements of the 3D flexible pouch.

In reference to FIG. 5, a pair of welding bars SB1 or similar elements of a welding unit, arranged along a longitudinal direction on the production line, bearing through the outside (against the abutment element 40) on the side edges 8, 9, 18, 19 of the wall elements 2 and 3 and make it possible to produce, in particular the side welded beams SL, here by thermal conduction for a short moment (method also called impulse welding). The conduction heating duration can be less than or equal to 4 or 6 seconds, given the increased temperature and typically greater than 150° C., preferably without exceeding 200° C. for the upper threshold of actual temperature ranges of the welding bars SB1. Thus, the welding step 52 can thus be carried out by continuously welding all or some of the longitudinal edges of the gussets 11 and 12 against the side edges 8, 18, 9, 19.

It is understood that this type of method is applicable to produce the oblique welded seams, for example during the step of producing the sealing 55, the welding bars or equivalent members to make it possible to rectilinearly weld only being arranged obliquely.

Outside of the join portions 25, 26, the width of each of these welded seams can be at least equal to 5 mm in order to minimize the risk of leakage by an accidental impact. In the join portions 25, 26, a welding area can be defined (corresponding, for example, to the portion CB), having at least the same width extension or an equivalent diameter greater than 5 mm. The welding area in the join portion 15, for example greater than 4 or 5 $cm^2$, preferably has a continuous, fully offset portion axially with respect to the gussets 11, 12 and extending on either side of the edges 25*a*, 25*b*.

At least along the welding zones and in the welded seams SL, SO1, SO2, the thickness of each of the films 102, 103, 111 and 112 is not reduced with respect to the thickness E of the films in the extended zones of the welded seams, the thickness E of these films 102, 103, 111, 112 being typically constant. In the welded seams SL, SO1, SO2 (and in particular in the join portion 25, 26), there is no frangible zone or other weakened region to make an opening possible.

As a non-limiting example, the thickness E (FIG. 12) is a constant thickness or possibly an average thickness and can be between 90 and 450 μm for each of these films 102, 103, 111 and 112.

It is understood that all of the welding steps are carried out without any prior introduction of material, contained such as a biopharmaceutical fluid 7, between the four elements constituting 2, 3, 11 and 12 the flexible pouch 1.

The flexible pouch 1 is closed hermetically on the four sides thereof when it is in the flat configuration, the access inside the pouch 1 only being permitted by the connection port 4, 6 which are closed in a later step (which can make it possible to vary the position and/or the size of the connection ports 4, 6, according to the desired biopharmaceutical application for the pouch).

In preferred applications, a filling of the flexible pouch 1 of 3D type can only be done subsequently to the complete sealing of the flexible pouch 1 and, preferably, to the formation of the connection port(s) 4, 6. It is understood that the sealed closing system(s) C1, C2 can be associated, from design, to the connection ports 4, 6, in order to avoid any air inlet in the flexible pouch 1. Thus, the flexible pouch 1 can be proposed empty, without the reduced orifice letting ambient air enter or, in a variant, systematically with the connection ports which form an inlet for the biopharmaceutical fluid and an outlet (placed on the same side as the inlet) to dispel air. This is particularly advantageous to keep a biopharmaceutical fluid 7 in a sterile state. The flexible pouches 1 of 3D type shown in FIGS. 2 and 9 make it possible for such a keeping in a sterile state. Preferably, the two opposite ends 14, 15 are designed identically.

In embodiment variants, the flexible pouch 1 has one single join portion on the side of the face W1, which is for example a lower face, while the other end 15 has another type of welded seam (for example a K-shaped welded seam) making it possible to form the opposite, upper face W2. The improved robustness advantages during the filling and/or the transportation are obtained on the side of the face W1.

In reference to FIG. 4, the distance between the opposite ends 14, 15 is typically a length L1 (length common to the wall elements 2, 3 but not to the gussets 11, 12) which exceeds the width L3 defined by the two wall elements 2 and 3. Furthermore, the following ratio is typically satisfactory:

$$0.05<D2/L3/<0.5$$

where D2 means a transversal space (minimum distance) between the first gusset 11 and the second gusset 12, measured along the transversal direction (same direction as for the measurement of the width L3).

One of the advantages of the flexible pouch 1 of 3D type is the robustness thereof, in particular in the ends of the gussets 11, 12 which are reinforced. Indeed, the induced fragilities due to the more or less large precision of the positioning of the welded seams at the level of the joins between the side welded seam and the angle welded seams which must perfectly be located facing the folds of the gussets to obtain a perfect K-shaped welded seam (the least fragile as possible) are removed. Furthermore, the flexible pouch 1 is obtained by a method which limits the number of steps of welding and cutting at the ends 14, 15.

It must be clear for people skilled in the art that the present invention makes it possible for embodiments under numerous other specific forms without moving away from the field of application of the invention as claimed. In particular, although the drawings illustrate the case of a join portion 25 which is ended by an angular free end 25*c*, such a free end can optionally have a curve, typically at a distance from the intersections J1, J2.

Furthermore, the flexible pouch 1 can, if necessary, be presented with an opening, for example a wide upper opening, situated on the side opposite the join portion 25 or 26, in particular for applications where an additional component must be introduced, then mixed, into the biopharmaceutical fluid.

The invention claimed is:

1. A 3D flexible pouch to be filled with a biopharmaceutical product, the flexible pouch being designed to be deployed from an empty, flat configuration towards a substantially parallelepiped configuration in a filled state, the flexible pouch comprising:

a first wall element consisting of a film and defining a front face, the first wall element having two side edges distributed on either side of a longitudinal axis of the pouch in the flat configuration;

a second wall element consisting of a film and defining a rear face, the second wall element having two additional side edges distributed on either side of said longitudinal axis of the pouch in the flat configuration;

a first gusset and a second gusset, each connected to one of said side edges of the first wall element and one of said additional side edges of the second wall element, the first gusset and the second gusset each being constituted by respective films cut out from one piece and each being foldable along a folding line towards the inside which extends between two opposite ends of the flexible pouch;

the longitudinal axis of the flexible pouch extending between the folding line of the first gusset and the folding line of the second gusset in the flat configuration; and at one of the two opposite ends, the films respectively constituting the first wall element and the second wall element are directly welded to one another, so as to define a join portion common to the side edges which, in the flat configuration, projects axially towards the outside with respect to the first and second gussets and is defined by two oblique edges which are oblique with respect to the longitudinal axis.

2. The flexible pouch according to claim 1, wherein the two oblique edges join together at a free end of the join portion and, in said flat configuration, the two oblique edges are spread apart from one another by extending from the free end and are each extended, opposite the free end, rectilinearly at least by one section of the side edges which is welded to a longitudinal edge section of one from among the first gusset and the second gusset.

3. The flexible pouch according to claim 2, wherein the free end of the join portion defines an angle of between 60 and 100°, which corresponds both to:

the angle between the two oblique edges in the flat configuration; and the angle between the first oblique welded seams of respective connection between the first and second gussets and the first and second wall elements, in the flat configuration.

4. The flexible pouch according to claim 1, comprising at least one connection port for filling and/or emptying, formed exclusively in one from among the first wall element and the second wall element.

5. The flexible pouch according to claim 1, wherein the join portion is flat and has, opposite a narrower free end of the join portion, a wide rectilinear base which extends transversally from either of the folding lines of the first and second gussets.

6. The flexible pouch according to claim 1, wherein the first wall element and the second wall element have one same longitudinal dimension which is greater than a maximum longitudinal dimension respectively of the first gusset and of the second gusset.

7. The flexible pouch according to claim 1, wherein the first wall element and the second wall element have one same hexagonal shape and mainly identical dimensions.

8. The flexible pouch according to claim 1, wherein the join portion is triangular, the respective side edges of either of the first and second wall elements each comprising an intermediate rectilinear section which extends between a first mainly rectilinear section and a second section, and being furthermore suitable for:

defining, through the intermediate respective sections, four rectilinear edges of the flexible pouch which are parallel to one another, both in said flat configuration and in said substantially parallelepiped configuration;

defining, through parts of the first sections, not welded to the first and second gussets, two sides of identical length of the join portion.

9. The flexible pouch according to claim 1, wherein the films respectively constituting the first wall element and the second wall element are welded to one another at the other of the two opposite ends so as to define an additional join portion of the side edges which projects axially towards the outside with respect to the first and second gussets in the flat configuration.

10. The flexible pouch according to claim 9, wherein the additional join portion, is defined by parts of the second sections not welded to the first and second gussets.

11. The flexible pouch according to claim 1, wherein the first gusset and the second gusset are each in a state folded in two in the flat configuration, by being folded towards the inside along the rectilinear folding lines parallel to the longitudinal axis.

12. The flexible pouch according to claim 1, comprising a connection port placed in a flap defined by the first wall element, on the side of the join portion and with a clearance with respect to the join portion.

13. The flexible pouch according to claim 1, wherein the films respectively constituting the first wall element, the second wall element, the first gusset and second gusset are welded by defining together in the flat configuration:

four continuous side welded seams which extend parallel to the longitudinal axis in the flat configuration; and four first continuous oblique welded seams which each extend from a determined end of one of the side welded seams up to the join portion.

14. The flexible pouch according to claim 13, wherein the films respectively constituting the first wall element, the second wall element, the first gusset and second gusset are welded so as to furthermore define in the flat configuration:

four second continuous oblique welded seams which each extend from an end of one of the side welded seams opposite the determined end up to the join portion.

15. The flexible pouch according to claim 13, wherein each of the welded seams has a minimum width at least equal to 5 mm.

16. The flexible pouch according to claim 13, wherein each of the films respectively constituting the first wall element, the second wall element, the first gusset and the second gusset locally has along the welded seams a thickness which is not less than the average thickness of said films, said average thickness being between 150 and 450 μm for each of these films.

17. The flexible pouch according to claim 1, wherein the films respectively constituting the first wall element, the second wall element, the first gusset and the second gusset are each composed of at least three plastic, non-metal layers, and are transparent or translucid.

18. The flexible pouch according to claim 17, wherein the films respectively constituting the first wall element, the second wall element, the first gusset and the second gusset each have a thickness of between 150 micrometers and 450 micrometers and a resistance to traction of between 60 and 220 Newtons.

19. The flexible pouch according to claim 17, wherein the first gusset and the second gusset each have:

an inner hot-weldable layer; and an outer weldable layer made of a material selected from among polyethylene, polyamide, ethylene-vinyl acetate copolymer, polyamide and ethylene poly terephthalate.

20. The flexible pouch according to claim 1, wherein:

a maximum transversal extension of each of the first and second gussets is at least 15 cm between the first wall element and the second wall element; and the flexible pouch makes it possible to define an inner space at least equal to 2 L, preferably at least equal to 5 L.

21. A method for producing a 3D flexible pouch to be filled with a biopharmaceutical product defined in claim 1 the pouch comprising:

a first wall element provided with two side edges, consisting of a film and defining a front face;

a second wall element provided with two side edges, consisting of a film and defining a rear face;

a first gusset and a second gusset, each constituted by a film cut from one piece and defined by two longitudinal edges;

the first gusset and the second gusset are inserted, in a state folded in two around a longitudinal folding line between the first wall element and the second wall element, the first gusset and the second gusset being arranged with a transversal space against one another;

the method further comprising:

producing a V-shaped cut out to define sections of side edges and sections of longitudinal edges which are oblique with respect to a longitudinal axis of the flexible pouch in an empty flat configuration, such that a tip of the V-shaped cut out are only defined by the first wall element and the second wall element in an intermediate zone situated, in the empty flat configuration, between a first virtual straight line coinciding with the longitudinal folding line of the first gusset and a second virtual straight line coinciding with the longitudinal folding line of the second gusset;

producing welded seams at the level of the respective longitudinal edges, in order to connect in a sealed manner, the first gusset and the second gusset between the first wall element and the second wall element;

producing a welded seam in a zone, adjacent or corresponding to the tip of the V-shaped cut out, in order to directly connect in a sealed manner, the first wall element to the second wall element; and the V-shaped cut out and the welded seams being produced such that the flexible pouch can be filled with a biopharmaceutical product in a parallelepiped configuration of the flexible pouch.

22. The method according to claim 21, wherein four first oblique welded seams which converge towards the tip of the V-shaped cut out are produced:

by welding the oblique sections of the two longitudinal edges of the first gusset to the first wall element and to the second wall element, respectively to an oblique section of one of the side edges of the first wall element and to an oblique section of one of the side edges of the second wall element, this thanks to which two first oblique welded seams are obtained; and by welding the oblique sections of the two longitudinal edges of the second gusset to the first wall element and to the second wall element, respectively to an oblique section of the other of the side edges of the first wall element and to an oblique section of the other of the side edges of the second wall element, this thanks to which two other first oblique welded seams are obtained.

* * * * *